United States Patent [19]

Hayes

[11] 4,108,390

[45] Aug. 22, 1978

[54] PAPER TAPE CANISTER

[75] Inventor: Hugh V. Hayes, Severna Park, Md.

[73] Assignee: The United States of America as represented by the Secretary of the Army, Washington, D.C.

[21] Appl. No.: 768,799

[22] Filed: Feb. 15, 1977

[51] Int. Cl.[2] ..... B65H 19/00

[52] U.S. Cl. ..... 242/55.53; 225/52

[58] Field of Search ..... 242/55.53, 71.1; 225/51, 52, 53, 54, 47, 45

[56] References Cited

U.S. PATENT DOCUMENTS

| | | | |
|---|---|---|---|
| 1,408,499 | 3/1922 | Casterline et el. | 225/52 X |
| 1,540,876 | 6/1925 | Dwyer | 242/55.53 |
| 2,189,533 | 2/1940 | Harvey | 225/54 X |
| 2,329,989 | 9/1943 | Hilquist | 242/71.1 |
| 3,283,886 | 11/1966 | Addis et al. | 242/55.53 |
| 3,384,318 | 5/1968 | Nerwin et al. | 242/71.1 |
| 3,820,738 | 6/1974 | Collins | 242/71.1 |

*Primary Examiner*—George F. Mautz

*Attorney, Agent, or Firm*—John R. Utermohle; Barry N. Young; Thomas O. Maser

[57] ABSTRACT

A low cost container for paper tape or the like from which the contents may be manually dispensed but which prohibits reinsertion of a tape once removed. The internal structure includes a maze-like path or labyrinth through which the tape may be easily pulled for removal. Efforts to move the tape backwards forces the tape into one or more small cavities which are filled by a small quantity of tape, thereby prohibiting further reinsertion.

4 Claims, 6 Drawing Figures

PAPER TAPE CANISTER

BACKGROUND OF THE INVENTION

1. Field of the Invention

This invention relates to the field of dispensing apparatus, and more specifically to dispensing apparatus having means to insure that the contents, once removed, may not be reinserted.

2. Description of the Prior Art

Devices for dispensing a flexible material such as paper tape are known in the prior art. For example, the webb unwinding apparatus, as described in U.S. Pat. No. 2,957,638 to Schiller et al., discloses such a device which includes means to prevent the tape from being reinserted, once removed, by means of cooperating rollers to produce a wedging effect. While this structure would be effective to prevent accidental reinsertion of the tape, it would be ineffective to prohibit intentional reinsertion. In addition, the complex arrangement of springs, rollers and similar moving parts in the prior art apparatus make the structure difficult and costly to produce in quantity.

There are applications where it is critically important that a paper tape be used once and only once. To effectively guard against reuse of such a paper tape, it would be desirable that the paper tape be used immediately upon being withdrawn from its container, and thereafter destroyed. To effectively insure that the tape being withdrawn has never been used before, it is desirable to have a tape dispensing apparatus which prohibits the reinsertion, either accidentally or intentionally, of tape once removed. It is to this end that the present invention is directed.

SUMMARY OF THE INVENTION

It is an object of this invention to provide a paper tape canister which allows easy removal of a predetermined portion of paper tape, but which prohibits reinsertion of the tape once removed.

It is a further object to provide such a canister which may be easily and inexpensively constructed.

It is a still further object to provide such a canister having no moving parts.

An apparatus for dispensing flexible materials such as paper tape, having these and other advantages, could compromise an enclosed case having therein a first cavity for the storage of a quantity of the material and an opening through which the material may be dispensed, and a labyrinth connecting the first cavity and the opening, the labyrinth including a second cavity located such that material reinserted into the opening will be directed thereto, thereby preventing reinsertion of but a small quantity of the material.

BRIEF DESCRIPTION OF THE DRAWINGS

The invention, and the following description thereof, may be more fully understood when considered with the attached drawings in which.

DESCRIPTION OF THE PREFERRED EMBODIMENT

Figure 1:
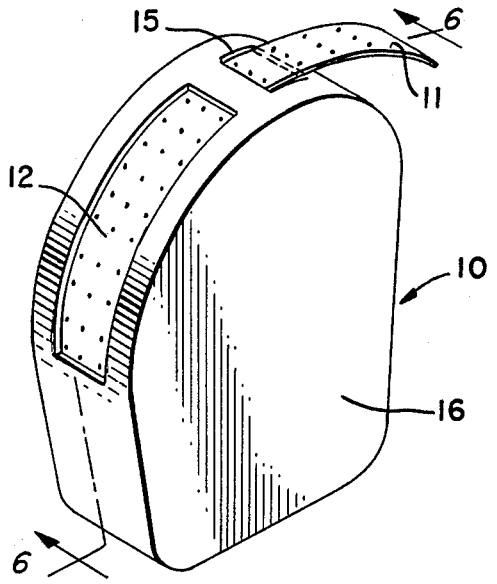
FIG. 1 is an isometric view of a preferred embodiment of a paper tape canister embodying the principles of the invention.

Referring to FIG. 1, a paper tape canister 10 is shown from which a strip of paper tape 11 or similar flexible material may be easily removed, but which can effectively prohibit the reinsertion of all but a very small portion of the tape once removed. For the purposes of the following description, it is to be understood that the prohibition on reinsertion may not necessarily be an absolute prohibition. It is intended, however, that reinsertion be made extremely difficult, so as to insure that it may be assumed with a high degree of reliability, that the material within the canister has not previously been removed.

The canister, which would normally be opaque, could be made of metal, plastic, glass or other similar moldable material. A portion of the tape 11 stored within the canister 10 passes by a window 12 and through an opening 15 in the canister. The window 12 is situated such that a user may push tape forward through the window until the tape end protrudes at the opening 15. Thereafter, the tape may be easily pulled through the opening 15 and the desired quantity removed. The window 12 further permits the user to view the tape as it is being pulled from the canister 10 and easily determine the amount of tape to be further removed, thereby preventing the accidental removal of too much tape.

The canister 10 may be effectively produced from two molded pieces, a canister cover 16 and a canister base 17, which are shown in more detail in FIGS. 2 through 6.

Figure 2:
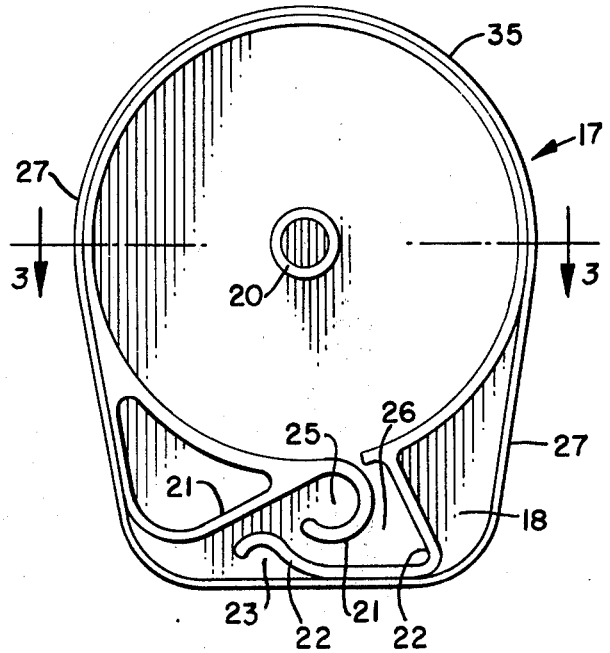
FIG. 2 is an interior view of the base of the canister shown in FIG. 1 with the cover removed.
Figure 3:
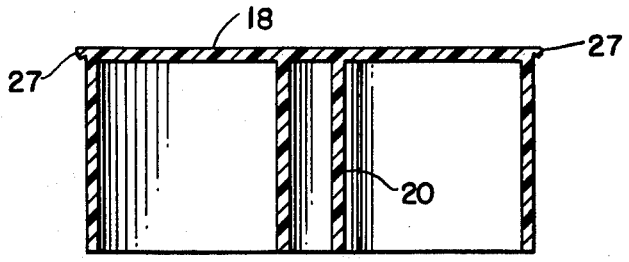
FIG. 3 is a sectional view taken along the line 3—3 of FIG. 2.

FIG. 2 is an interior view of a canister base 17, with canister cover 16 removed, embodying the elements of the invention. The base includes a platform 18 having mounted thereon a spindle 20 upon which a roll of paper tape 11 may be placed. A plurality of partitions 21—21, 22—22 are molded onto the platform 18 to provide a labyrinth, i.e., a maze-like series of passageways from the inner portion of the canister to the exterior. The partitions 21—21, 22—22 which may be configured in any of a large number of possible ways, must create at least a first cavity 23, and more desirably one or more additional cavities 25 and 26. It is into one or more of these cavities that the paper tape will be forced upon an attempt to push the paper tape 11 back into the canister 10. The cavities should be made sufficiently small that they will fill upon the reinsertion of a small quantity of paper tape, thereby prohibiting further insertion of tape. A lip 27 extends around the perimeter of the platform 18 onto which the canister cover 16 (shown in FIGS. 4 and 5) may be mounted and permanently attached. FIG. 3 shows a sectional view of the base of FIG. 2. The lip 27 is more clearly evident from this view. The height of the partitions 21—21, 22—22 must be sufficient to hold the inserted paper tape within and short enough to permit the wall 32 of the cover 16 to rest snugly against the lip 27 of the base 17 when the canister is assembled.

Figure 4:
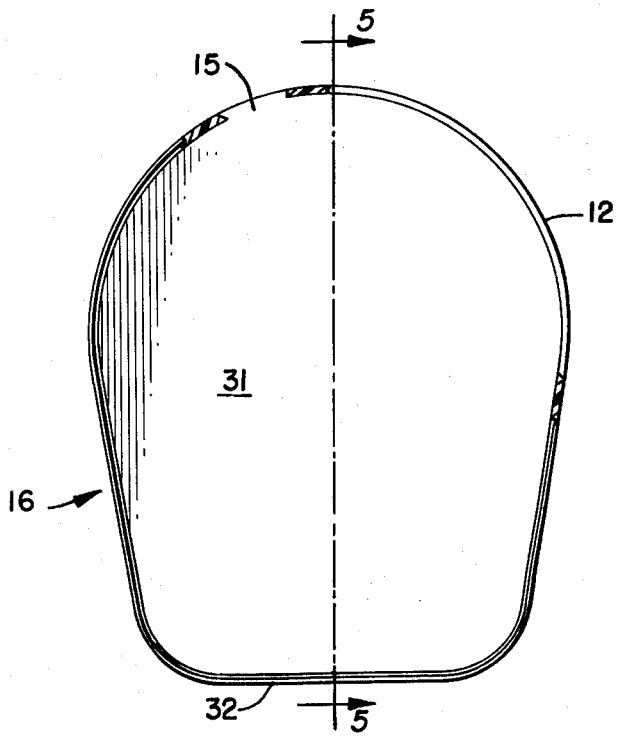
FIG. 4 is a interior view of the cover of the canister shown in FIG. 1.
Figure 5:
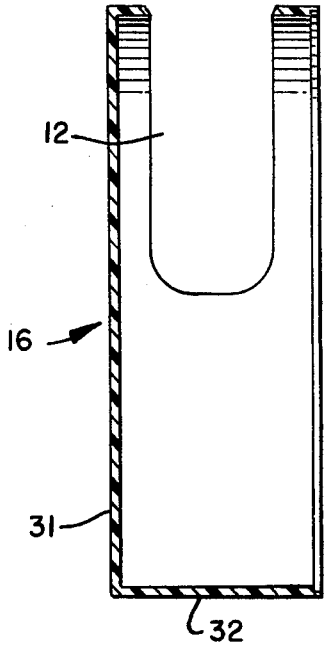
FIG. 5 is a sectional view taken along the line 5—5 of FIG. 4.

A canister cover 16, shown in FIGS. 4 and 5, consists of a molded piece of substantially the same size as the base 17. It includes a platform 31 on the periphery of which is constructed a wall 32. A window 12 is cut through the wall 32, the width of the window preferably being slightly narrower than the width of the tape. An opening 15 is also cut through the wall, the width of the opening being sufficient to allow the tape to pass through.

Once the canister cover and base are fabricated, the assembly process is quickly and easily completed. A roll of paper tape is placed onto the spindle 20, and the end of the roll is threaded through the labyrinth created by the partition 21—21, 22—22 which form the cavities 23, 25 and 26. The tape is preferably held tightly against the outer edge of the partition to about the point 35, which is approximately where the cover opening 15 will be located once the canister is assembled. The cover 16 is then fitted over the base 17 such that the end of the tape protrudes out of the opening 15 and the cover fits snugly onto the lip 27. The base 17 and the cover 16 are then sealed by any effective means to produce a unitary enclosed canister. Examples of such sealing methods may include epoxy gluing or ultrasonic welding.

Figure 6:
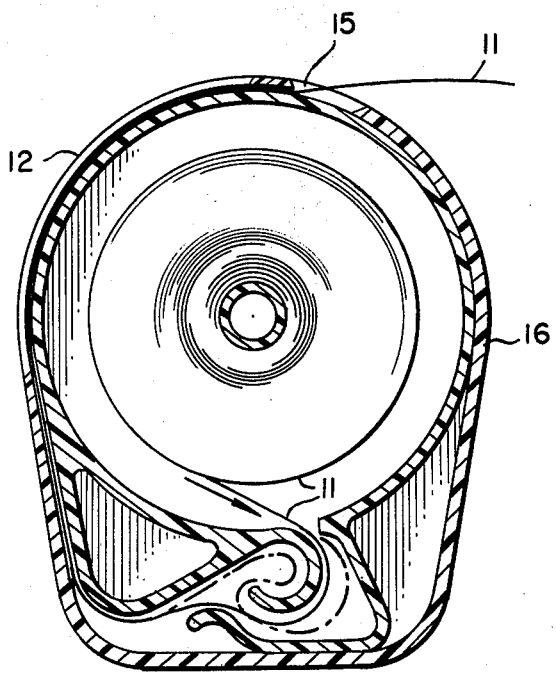
FIG. 6 is a sectional view taken along line 6—6 of FIG. 1, which illustrates the functioning of the paper tape canister with a roll of paper tape inserted therein.

FIG. 6 is a sectional view of an assembled canister with a roll of the paper tape 11 installed therein, illustrating the manner in which the tape is threaded through the labyrinth, around the outer edge of the partition and through the window 15. The dashed lines indicate how the tape fills the cavities to prohibit the reinsertion of tape once removed, upon an attempt to push the tape back into the canister.

It is obvious that the paper tape must be inserted and routed through the labyrinth prior to the fitting of the canister cover. Once the cover is in place, at least a sufficient quantity of the tape must be observable through the window 12 that it may be pushed by finger pressure toward the opening 15 to be withdrawn as required for use.

It is to be understood that the particular configuration of the canister described herein above is a preferred embodiment of the invention, and that the inventor does not intend that his invention be limited thereby. Any number of configurations of the labyrinth can be constructed to produce the cavity or cavities which will effectively prohibit reinsertion of a paper tape. It is intended that the invention be limited only by the claims as appended.

I claim:

1. An apparatus for dispensing a flexible material comprising:

an enclosed case having therein a first cavity for the storage of a quantity of said material and an opening through which said material may be dispensed; and a labyrinth formed by a plurality of curved partitions interior to said enclosed case, said labyrinth constituting a tortuous path connecting said first cavity and said opening for the passage of material from said first cavity to said opening, said labyrinth further including a plurality of second cavities formed by said partitions, said second cavities disposed with respect to said path such that material reinserted into said opening will be directed thereinto, thereby prohibiting the reinsertion into said first cavity of material once removed therefrom.

2. The apparatus of claim 1 wherein said second cavities are small with respect to said first cavity, thereby permitting the reinsertion of only a small quantity of said material into said enclosed case.

3. The apparatus of claim 2 wherein said material is in the shape of a flat tape and said first cavity is substantially circular in shape, having contained therein a spindle for rotatably mounting thereon a roll of said material.

4. The apparatus of claim 3 where said enclosed case comprises:

a base having mounted thereon said labyrinth forming partitions, said spindle and a second partition forming said first cavity; and a cover comprising a flat surface having a wall perpendicular to and around the periphery of said flat surface, said wall containing said opening for dispensing said material, said cover shaped and dimensioned to engage said base so as to form an enclosed case, such that a narrow passageway for said material connecting said labyrinth and said opening is provided between a portion of the interior of said wall and said second partition forming said first cavity.

* * * * *